United States Patent [19]

Stahlecker

[11] 4,098,066

[45] Jul. 4, 1978

[54] OPEN-END SPINNING MACHINE

[75] Inventor: Fritz Stahlecker, Bad Uberkingen, Fed. Rep. of Germany

[73] Assignees: Fritz Stahlecker; Hans Stahlecker, both of Fed. Rep. of Germany

[21] Appl. No.: 726,070

[22] Filed: Sep. 24, 1976

[30] Foreign Application Priority Data

Dec. 2, 1975 [DE] Fed. Rep. of Germany ..... 2554102

[51] Int. Cl.[2] ..... D01H 13/16

[52] U.S. Cl. ..... 57/80; 57/34 R

[58] Field of Search ..... 57/34 R, 58.89, 58.95, 57/80–81

[56] References Cited

U.S. PATENT DOCUMENTS

| | | | |
|---|---|---|---|
| 3,810,352 | 5/1974 | Miyazali et al. | 57/34 R |
| 3,879,926 | 4/1975 | Burtling et al. | 57/34 R X |
| 3,950,926 | 4/1976 | Stableeker | 57/34 R |

*Primary Examiner*—Richard C. Queisser
*Assistant Examiner*—Charles Gorenstein
*Attorney, Agent, or Firm*—Craig & Antonelli

[57] ABSTRACT

An open-end spinning machine has a number of spinning units and a movable maintenance device. The maintenance device has means for deflecting the thread monitoring sensors of the spinning units, there being a sensor associated with the thread draw-off path of each unit. The deflecting means provides for indirect, non-contacting deflection of a thread monitoring sensor.

11 Claims, 4 Drawing Figures

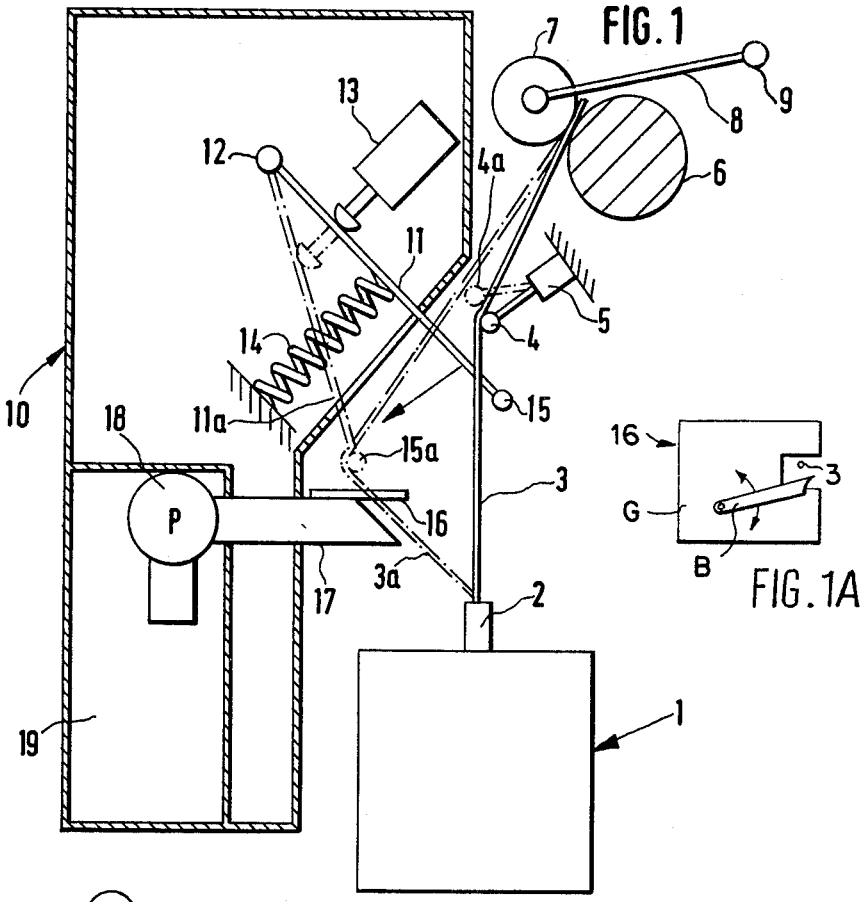
FIG. 1
7
9
8
6
13
12
4a
11
5
4
14
10
18
11a
15
15a
16
3
P
16
3a
17
2
1
19
G
B
3
FIG. 1A
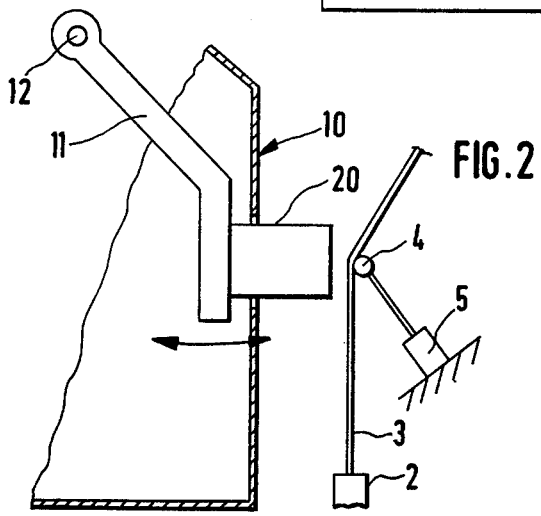
12
11
10
20
FIG. 2
4
5
3
2

OPEN-END SPINNING MACHINE

FIELD OF THE INVENTION

This invention relates to an open-end spinning machine having a number of spinning units and at least one movable maintenance device which is equipped with means for displacing thread monitoring sensors, one of which is arranged in a thread draw-off path of each spinning unit.

DESCRIPTION OF THE PRIOR ART

German Patent Specification No. 2,350,840 discloses an open-end spinning machine having a movable maintenance device which can intermittently interrupt the spinning process of the individual spinning units. This deliberate interruption, which is followed by cleaning of the spinning unit and subsequent resumption of spinning, is for the purpose of maintaining consistent operating conditions as far as possible, to avoid differences in yarn quality. Otherwise, such differences can arise after a certain operating time during which dirt can be deposited in the spinning unit, particularly in its open-end spinning rotor. After a certain operating time not only does the quality of the yarn deteriorate, but the frequency of thread breakages increases; this can also be prevented by timely cleaning.

It is usual for each spinning unit machine to be equipped with a thread monitoring sensor, that is, a sensor which monitors the presence of the thread. The sensor is held in its operating position by the thread tension. On breakage of the thread, it switches over and interrupts operation of a device which feeds fibre lap to the spinning unit. In order to bring about a thread breakage deliberately, the thread monitor can be moved into the position which indicates a breakage in the thread, where it switches off the supply of fibre lap. This is envisaged for the known maintenance device. However, how this is to be carried out in practice is left open and in fact difficulties can arise if the thread monitoring sensor is switched from the movable maintenance device. The thread monitoring sensor must be very sensitive so that it can respond to the relatively light tension of the thread. The construction of mechanical actuating means which will not cause damage to the thread monitoring sensor even after long operating times, and will continue to switch reliably, presents considerable difficulties.

SUMMARY OF THE INVENTION

It is an object of the invention to provide, in an open-end spinning machine, the possibility of deliberate displacement of the thread monitoring sensor, without danger of damaging the sensor.

According to this invention there is provided in an open-end spinning machine comprising a plurality of spinning units, a thread monitoring sensor associated with the thread draw-off path of each spinning unit, at least one movable maintenance device, the maintenance device having means for displacing a respective thread monitoring sensor, the improvement wherein the said deflecting means provides for indirect, non-contacting displacement of the sensor. By use of the invention, mechanical elements are excluded from contact with the thread monitoring sensor, which could lead to overloading and damage.

In one embodiment of the invention, the maintenance device is equipped with means for deflecting a running thread and for lifting the thread from its associated monitoring sensor. With such means, the maintenance device slackens off the thread tension in the vicinity of the monitoring sensor sufficiently for a breakage in the thread to be simulated, to interrupt the supply of fibre lap and cause an actual breakage in the thread.

The maintenance device may have a blade which can be moved up to the running thread of a spinning unit. This embodiment is based on the fact that the thread end which is produced when the fibre lap suppy is cut off is not suitable for resumption of spinning as the thread end tails off due to the interrupted delivery of fibre. If however the running thread is cut off, a better thread end is produced rejoining the thread, and having a shape which corresponds to the rest of the thread.

In another embodiment of the invention provision is made for the maintenance device to have a magnet which can be brought up to a respective thread monitoring sensor, all the sensors each having a magnetic part. This embodiment also prevents the thread monitoring sensor from being damaged by forcible mechanical switching off.

In another embodiment the maintenance device has means for opening part of the housing of the spinning unit, which part bears the relevant thread draw-off channel, whilst the thread monitoring sensor of the spinning unit is mounted in stationary manner. In this embodiment the running thread is deflected by opening the housing so that the thread monitoring sensor is released sufficiently for it to interrupt the supply of fibre lap.

BRIEF DESCRIPTION OF THE DRAWINGS

FIG. 1 is a diagrammatic section through part of an open-end spinning machine with a first embodiment of maintenance device;

FIG. 1A is a schematic view of a thread cutting device of the FIG. 1 maintenance device;

FIG. 2 is similar to FIG. 1, showing another embodiment;

DESCRIPTION OF THE PREFERRED EMBODIMENTS

Figure 3:
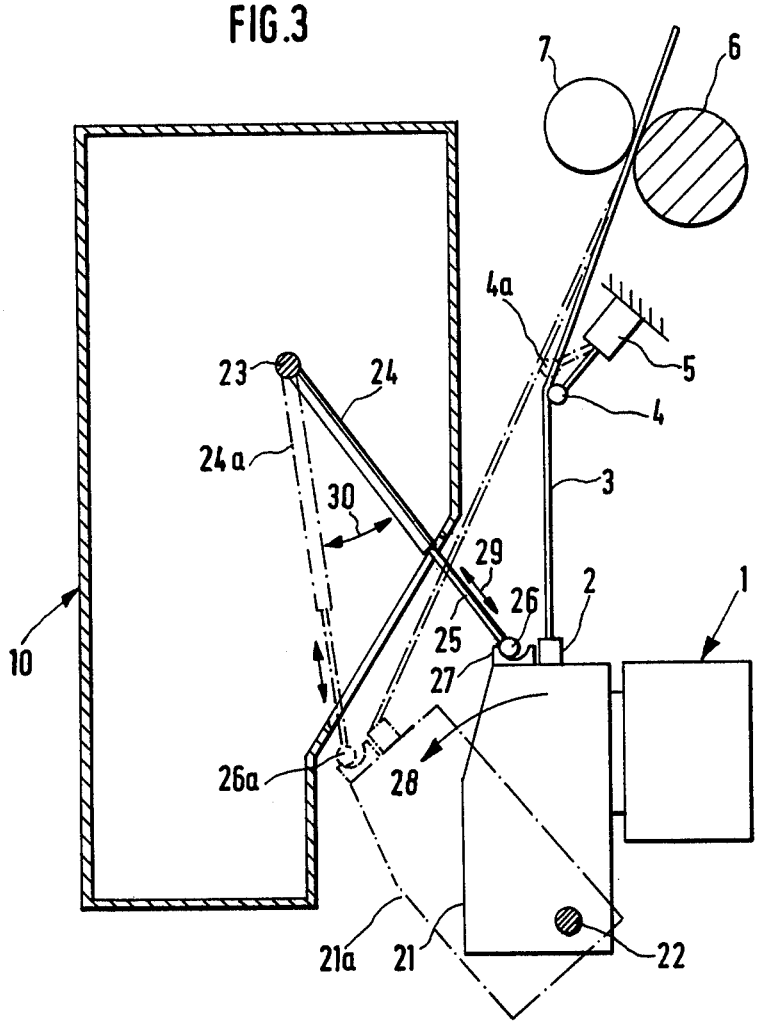
FIG. 3 is similar to FIG. 1, showing another embodiment.

Referring to FIG. 1, there is seen an open-end spinning unit 1, a number of which are usually arranged in a row one beside another, the unit having a yarn draw-off channel 2, whence a thread 3 is drawn by a pair of draw-off rollers 6, 7 and fed to a spooling device, not shown. The thread 3 is guided with a small deflection as shown, and thus under slight tension, over a thread monitoring sensor 4 which is connected to a switch 5 to cut off the supply of a fibre lap to the unit 1, the switch 5 being in an electrical circuit (not shown). The switch is operated by the sensor 4 when the latter is not held in its operating position by the thread 3. The operating position is indicated in full lines. The sensor has a spring which swings it out of its operating position if the thread tension is not present. The driven draw-off roller 6 is preferably a shaft running lengthwise through the whole spinning machine. The draw-off roller 7 is a pressure roller and is pivotally mounted by an arm 8 on an axle 9 fixed in the machine.

A maintenance device 10, which is only shown schematically, can be moved over the whole length of the machine. This device 10 can comprise in known manner devices for cleaning the spinning unit 1 and/or devices for joining a broken thread 3 and/or for changing spools. The device 10 has means for interrupting the thread 3 by contact-free actuation of the sensor 4. In the embodiment of FIG. 1 a lever arm 11 is mounted for pivoting about an axis 12 and against a compression coil spring 14, in the direction of the arrow, by an actuator in the form of a solenoid 13. Transversely of the lever 11 is a projection 15 which can deflect the thread 3 to the position 3*a* indicated in dot-dash lines. The lever 11 and projection 15 then assume positions 11*a* and 15*a*. On deflection of the thread to its position 3*a*, it is lifted off the sensor 4, so that the tension is removed therefrom and so that the sensor moves to its position 4*a*, i.e. into its thread-broken position, in which it causes interruption of the supply of fibre lap.

In this way, and without need of any other provision, a thread end is produced which is drawn through the draw-off rollers 6, 7 and finally wound onto the winding spool, not shown. This thread end would be somewhat attenuated and therefore would not be favourable for resumption of spinning. For this reason, a cutting device 16 is also provided on the movable maintenance device 10, so that at this point a thread end of correct shape is produced. FIG. 1A schematically depicts cutting device 16 with a movable blade B, guided in guide G, for cutting thread 3. The thread end which is not drawn off is sucked into a container 19 by a suction device 17 connected to a reduced pressure source 18.

It is possible for the thread end 3*a* to be removed in other ways, for example by means of a spinning rotor at low pressure located in the unit 1 which sucks the thread end into unit 1 from where it can be further sucked out by a suction line or the like.

FIG. 2 shows an embodiment for contact-free actuation of the thread monitoring sensor 4 of a spinning unit, of which, other than the sensor 4 itself, only the switch 5, the yarn draw-off channel 2 and a part of the operative run of thread 3 are shown. The movable maintenance device 10 in this embodiment also has a lever 11 which can be deflected around an axis 12, and which is fitted at its end with a magnet 20. The magnet 20 is movable as indicated by the arrow into the vicinity of the sensor 4 and can deflect the sensor from its operating position. Either a permanent magnet or an electromagnet can be used. When required, the lever 11 is moved back, drawing the sensor magnetically with it. For this purpose the sensor 4 contains a bar of magnetic material. In this way spinning can be interrupted.

Both the above-described embodiments exhibit interruption of spinning by displacement of a thread monitoring sensor 4 without the latter coming into mechanical contact with the actuating element. In this way the sensor 4 is protected and its operation not prejudiced.

FIG. 3 shows another embodiment, in which spinning is interrupted simply by opening the spinning unit 1. A housing 21 is movable, about a stationary axis 22 at each spinning unit, to the dash-dot line position 21*a*. As the yarn draw-off channel 2 is also swung away with it, the thread path 3 assumes a new position, as indicated by dash-dot lines and in this way the sensor 4, which does not move with the housing 21, is released to move into its position 4*a* and thus cuts off the supply of fibre lap.

To bring about this movement of the housing 21 actuating elements 23 to 26 are provided on the movable maintenance device 10, and they take the form of a pivot arm which can be deflected about an axis 23 as indicated by the double arrow 30. They form a telescopically extensible unit. This unit comprises a piston rod 25 which can be moved as indicated by the double arrow 29 in a cylinder 24. The piston rod 25 has on its end a ball 26 seated in a guideway 27 on the housing 21. During opening this ball moves to the position 26*a*, thereby moving the housing 21 to its position 21*a*.

As it is advantageous to open the spinning unit in any case for cleaning, the embodiment of FIG. 3 provides a simple appliance for interrupting spinning. It is only necessary not to arrange the thread monitoring switch 5 and the thread monitoring sensor 4 on the housing 21 (as is often normal practice) but on a stationary point somewhat removed from the housing 21, so that the thread 3 can be lifted from the sensor 4.

What is claimed is:

1. In an open-end spinning machine comprising at least one spinning unit, a thread monitoring sensor associated with the thread draw-off path of each spinning unit, each of said thread monitoring sensors including a thread engaging member which is maintained in a first position by a running thread in said draw-off path and which is movable to a second position away from said draw-off path, at least one movable maintenance device, the maintenance device having deflecting means for deflecting a respective thread engaging member away from its first position, the improvement wherein said deflecting means comprises means for indirect, non-contacting displacement of the thread engaging member.

2. An open-end spinning machine according to claim 1, characterized in that said deflecting means comprises a device for deflecting a running thread away from its associated thread engaging member without directly contacting said thread engaging member.

3. An open-end spinning machine according to claim 2, wherein said machine comprises a plurality of spinning units, and wherein said maintenance device is selectively movable to respective maintenance positions adjacent each of the spinning units.

4. An open-end spinning machine according to claim 1, characterised in that the maintenance device also comprises a blade, which blade can be brought up to the running thread, and a guiding device for guiding the blade.

5. An open-end spinning machine according to claim 1, characterized in that said deflecting means comprises a magnet which can be brought up to adjacent the thread engaging member said thread engaging member being fitted with a magnetic part.

6. An open-end spinning machine according to claim 5, wherein said machine comprises a plurality of spinning units, and wherein said maintenance device is selectively movable to respective maintenance positions adjacent each of the spinning units.

7. An open-end spinning machine according to claim 1, characterised in that the deflection means comprises means for opening a housing of the spinning unit which housing carries the relevant thread draw-off channel, the thread monitoring sensor being mounted in a stationary manner on the spinning unit.

8. An open-end spinning machine according to claim 7, wherein said machine comprises a plurality of spinning units, and wherein said maintenance device is selectively movable to respective maintenance positions adjacent each of the spinning units.

9. An open-end spinning machine according to claim 1, wherein said machine comprises a plurality of spinning units, and wherein said maintenance device is selectively movable to respective maintenance positions adjacent each of the spinning units.

10. An open-end spinning machine according to claim 9, characterised in that the maintenance device also comprises a blade for cutting a running thread.

11. An open-end spinning machine according to claim 10, characterised in that a suction nozzle is associated with the blade.

* * * * *